US006051162A

United States Patent [19]

Vandensype et al.

[11] Patent Number: 6,051,162

[45] Date of Patent: Apr. 18, 2000

[54] PROCESS FOR THE GENERATION OF A LOW DEW-POINT, OXYGEN-FREE PROTECTIVE ATMOSPHERE FOR THE PERFORMANCE OF THERMAL TREATMENTS

[75] Inventors: Jaak Stefaan Vandensype, Katonah, N.Y.; Gianluca Porto, Turin, Italy

[73] Assignee: Praxair Technology, Inc., Danbury, Conn.

[21] Appl. No.: 09/037,969

[22] Filed: Mar. 11, 1998

[30] Foreign Application Priority Data

Mar. 18, 1997 [IT] Italy ..... TO97A0223

[51] Int. Cl.[7] ..... B01J 8/00; B01D 47/00; C01B 3/00; C01B 21/00; C01B 31/18; C07C 1/00

[52] U.S. Cl. ..... 252/372; 252/373; 252/374; 252/375; 252/376; 423/210; 423/220; 423/230; 423/235; 423/239.1; 423/245.1; 423/245.3; 423/246; 423/247; 423/248

[58] Field of Search ..... 423/219, 247, 423/351, 248, 210, 220, 230, 235, 239.1, 245.1, 245.3, 246; 148/208, 629, 633, 634, 16, 95, 206, 207, 559, 566, 625, 626, 627, 628; 568/470; 252/372, 373, 374, 375, 376

[56] References Cited

U.S. PATENT DOCUMENTS

| | | | |
|---|---|---|---|
| 5,045,297 | 9/1991 | Bonifaz et al. | 423/437 |
| 5,057,164 | 10/1991 | Nilsson et al. | 148/16 |
| 5,069,728 | 12/1991 | Rancon et al. | 148/16 |
| 5,298,090 | 3/1994 | Garg et al. | 148/208 |
| 5,320,818 | 6/1994 | Garg et al. | 423/351 |
| 5,401,339 | 3/1995 | Garg et al. | 148/629 |
| 5,417,774 | 5/1995 | Garg et al. | 148/208 |
| 5,441,581 | 8/1995 | Van Den Sype et al. | 148/634 |
| 5,779,826 | 7/1998 | Nayar et al. | 148/633 |
| 5,856,585 | 1/1999 | Sanfilippo et al. | 568/470 |

FOREIGN PATENT DOCUMENTS

| | | |
|---|---|---|
| 0603799 | 6/1994 | European Pat. Off. . |
| 0692545 | 1/1996 | European Pat. Off. . |
| 9321350 | 10/1993 | WIPO . |

OTHER PUBLICATIONS

O. V. Krylov, Catalytic Reactions of Partial Methane Oxidation, Catalysis Today 18 (1993) 209–302.

*Primary Examiner*—Gary P. Straub
*Assistant Examiner*—Eileen E. Nave
*Attorney, Agent, or Firm*—Bernard Lau

[57] ABSTRACT

A process for the generation of a protective nitrogen-based atmosphere for the performance of heat treatments of metal articles in three phases, including an initial phase in which a gaseous hydrocarbon feed and an oxidant containing oxygen react on a first catalyst to form a reaction product, a second phase in which the reaction product is added to nitrogen contaminated by the presence of oxygen and a third phase in which the reaction product is conveyed to a second catalyst to form a low-dew point gaseous mixture as a protective atmosphere.

14 Claims, 1 Drawing Sheet

PROCESS FOR THE GENERATION OF A LOW DEW-POINT, OXYGEN-FREE PROTECTIVE ATMOSPHERE FOR THE PERFORMANCE OF THERMAL TREATMENTS

FIELD OF THE INVENTION

The present invention relates to a process for the generation of a protective nitrogen-based atmosphere for the performance of heat treatments of metal articles, such as annealing, tempering, pre-temper heating and the like.

BACKGROUND OF THE INVENTION

Conventionally, the nitrogen utilized for such purposes was obtained by cryogenic means at considerable cost. More recently, therefore, attempts were made to utilize nitrogen produced by methods more economical than the cryogenic process, for example, by the passage through diaphragm membranes or by pressure-swing adsorption (PSA).

Nevertheless, the nitrogen so obtained presents the drawback of impurity, containing as it does small fractions, between 0.1% and up to about 5% of oxygen, with decisively deleterious effects on the pieces submitted to such heat treatment. Therefore, numerous procedures have already been proposed to reduce and/or eliminate the content in oxygen or oxidant derivative substances, such as water and carbon dioxide, in nitrogen produced by noncryogenic methods, so as to purify the latter and if need be combine it with reducing additives, such as carbon monoxide and hydrogen, which exert a beneficial effect on the heat treatment process.

As an example, WO-A-93 21 350 describes an endothermal catalytic process, wherein hydrocarbons are made to react to oxygen contained in the nitrogen impurities, in a reactor chamber containing conventional nickel oxide catalysts, or catalysts based on noble metals, essentially resulting in the formation of carbon monoxide and hydrogen, in preference to undesirable oxidizing compounds. Notwithstanding the presence in heat treatment furnaces of heat exchangers designed to preheat the gas intended to react in such a reactor, it is nevertheless necessary to supply heat from the outside, in order to activate the partial oxidation reaction of hydrocarbons with oxygen. On the whole, therefore, the economics of the process are adversely affected by the need to provide pre-heating exchangers and supply large quantities of outside heat.

EP-A-0 603 799 describes a process for the catalytic conversion of oxygen included in non-cryogenic nitrogen, by means of hydrocarbons, so as to determine—in view of the low temperature of a suitable conversion reactor—the formation of fully oxidized water and carbon dioxide. These are then converted into reducing compounds by re-forming reactions with excess hydrocarbons present in the heat treatment furnace. Nevertheless, the kinetics of the reforming reactions is decisively slow at typical operating temperatures of such furnaces, so much so that to arrive at desirable compositions, it is necessary to provide extended dwelling times, forced gas recycling systems and the like, thus limiting the practical applicability of the process.

EP-A-0 692 545 describes a catalytic system based on noble metals, in which impure nitrogen produced by noncryogenic means is made to react directly with hydrocarbons. To secure preferential formation of reducing agents, it is necessary to work at high temperatures, requiring outside heat input, which again has a negative effect on the economics of the process.

SUMMARY OF THE INVENTION

With a view to overcoming the drawbacks of known technology, the present invention envisages a process consisting of:

Phase One, in which a gaseous hydrocarbon feed and an oxygen-containing oxidant are made to react with a first catalyst chosen from the group consisting of noble metals, oxides and mixtures thereof, at a temperature in the range of about 750° C. to about 900° C. and a spatial velocity of at least 10,000 $h^{-1}$, thus forming a reaction product comprising carbon monoxide, hydrogen and hydrocarbons, along with lesser quantities of water and carbon dioxide.

Phase Two, in which the reaction product is added to nitrogen contaminated by the presence of oxygen, reacting in its totality with a portion of the said hydrogen and carbon monoxide, forming additional water and carbon dioxide, and Phase Three, in which the product obtained in Phase Two is fed over a second catalyst, chosen from a group containing noble metals, at a temperature ranging from about 400° C. to about 750° C., forming a gaseous low dew-point mixture, consisting essentially of nitrogen, hydrogen and carbon monoxide, such mixture being suitable for use as a protective atmosphere in heat treatments.

BRIEF DESCRIPTION OF THE DRAWINGS

Other objects, features and advantages will occur to those skilled in the art from the following description of preferred embodiments and the accompanying drawing in which the sole FIGURE is a schematic representation of a process for generating a protective atmosphere for the execution of thermal treatments according to this invention.

DETAILED DESCRIPTION OF THE PREFERRED EMBODIMENT

Figure 1:
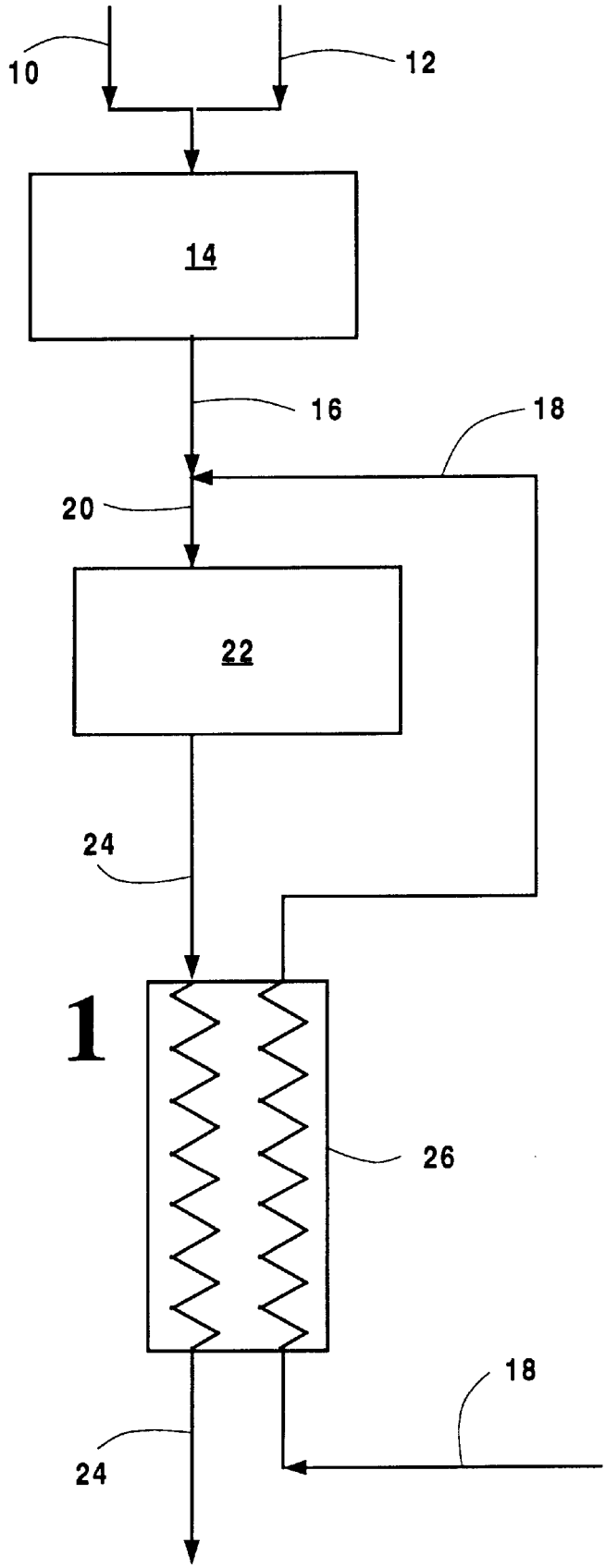

This invention is directed to a process for the generation of a protective atmosphere for the performance of thermal treatments in three phases:

Phase One, in which a gaseous hydrocarbon feed and an oxygen-containing oxidant are made to react with a first catalyst chosen from the group consisting of noble metals, oxides and mixtures thereof, at a temperature in the range of about 750° C. to about 900° C. and a spatial velocity of at least 10,000 $h^{-1}$, thus forming a reaction product comprising carbon monoxide, hydrogen and hydrocarbons, along with lesser quantities of water and carbon dioxide;

Phase Two, in which the reaction product is added to nitrogen contaminated by the presence of oxygen, reacting in its totality with a portion of the said hydrogen and carbon monoxide, forming additional water and carbon dioxide; and Phase Three, in which the product obtained in Phase Two is fed over a second catalyst, chosen from a group containing noble metals, at a temperature ranging from about 400° C. to about 750° C., forming a gaseous low dew-point mixture, consisting essentially of nitrogen, hydrogen and carbon monoxide, such mixture being suitable for use as a protective atmosphere in heat treatments.

The thermal efficiency of the invented process is distinctly superior to known processes which involve a direct reaction between oxygen present in the impure nitrogen and hydrocarbons, notably methane or natural gas.

To permit formation of the desired reducing compounds with acceptable kinetics, it is in fact necessary in this latter case to work at temperatures on the order of at least 750° C., calling for the input of substantial amounts of outside heat.

Conversely, according to the invented process, the above mentioned direct reaction is avoided, with its deleterious kinetic and thermodynamic drawbacks, and instead an indirect reaction is pursued by way of the three reaction stages previously described, with a limited input of outside heat.

More specifically, Phase One leads to the formation of hydrogen and carbon monoxide, which in Phase Two react very quickly and easily with oxygen contained as an impurity in nitrogen. Hence, it is in that phase that oxygen is completely eliminated, concurrently with the formation of carbon dioxide and water, whose reforming into hydrogen and carbon monoxide is facilitated in Phase Three.

It should moreover be noted that the catalysts utilized in Phase One, notably those of the oxide type, promote the formation of unsaturated hydrocarbon molecules, for example, ethylene and propylene, which in turn promote thermodynamic equilibrium and the kinetics of Third-Phase reforming.

The reaction leading to the formation of unsaturated hydrocarbons starting from oxygen and saturated hydrocarbons, particularly methane, is referred to as the "oxidative coupling". An article by O. V. Krylov, published under the title of Catalytic Reactions of Partial Methane Oxidation, in Catalysis Today, Vol. 18 p. 209–302, 1993, contains a comprehensive review of processes followed to achieve oxidative coupling reactions.

So far, the unsaturated hydrocarbons produced in this manner have not proved adapted for use on an industrial scale in the production of the corresponding polymers. Still, in the course of the Third-Phase reforming reaction envisaged in this invention, they play a role extremely beneficial to the formation of desirable reducing compounds, as demonstrated in experimental tests (cf. Example 3 below).

In the invented process, the hydrocarbon infeed is preferentially made up of methane, propane or natural gas, whereas the oxygen-containing oxidant preferentially utilized is air.

Depending on the desired quantity of reduction agents in the final gaseous mixture, it is a matter of convenience to adjust the rate of flow of different raw materials used in the process. In particular, the ratio of air to hydrocarbon infeed may range between 2.3 and 0.5, preferably 2 and 0.8, whereas the ratio between the input of impure nitrogen and the reaction product in Phase One may range between 10 and 1, preferably 6 and 1.

Both the first and the second catalyst may utilize a ceramic substrate, the catalyst being in this case chosen from [a group composed of ruthenium, rhodium, palladium, osmium, platinum and mixtures thereof.

Again by way of an example, the ceramic substrate may be chosen from a] group consisting of alumina, magnesium oxide, silica, zirconium oxide, titanium oxide and mixtures thereof.

As previously mentioned, if the intent is to enhance the unsaturated hydrocarbon content in the gaseous products present in Phase One, it is preferable to use an initial oxide-type catalyst, chosen for example from a group consisting of Li/MgO, $Li/SM_2O_3$, $Sr/La_2O_3$ and mixtures thereof.

The invention will now be described in greater detail based on the following examples and the single drawing illustrating schematically the plant needed for its implementation. The examples and the figure are merely illustrative and the invention is not limited thereto.

EXAMPLE 1

A mixture of air 10 and natural gas 12 in an air-to-methane gas ratio of 1.8, is fed to an oxidative coupling reactor 14 (FIG. 1) containing as catalyst 1% by weight of platinum on an alumina substrate. The space velocity meaning the flow rate of gas so produced per unit of volume of the catalyst is 50,000 $h^{-1}$ and the temperature of the gas at outlet 16 is 750° C. The gas composition is as follows:

CO=17.9%

$H_2$=36.2%

$CO_2$=1.0%

$CH_4$=9.5%

$N_2$=Remainder to 100%

The gases 16 are then added to impure nitrogen 18 containing 1% oxygen obtained by membrane separation. The ratio between the impure nitrogen 18 and the gas 16 equals 3. The oxygen contained in nitrogen 18 reacts immediately with a portion of the carbon monoxide and hydrogen contained in gases 16, to form water and carbon dioxide. The gas mixture 20 so obtained is fed to a reforming reactor 22 containing as catalyst 1% by weight of platinum, on an alumina substrate. The spatial velocity is 25,000 $h^{-1}$ and the mean temperature is 652° C. The composition of the gases 24 exiting from reactor 22 is as follows:

$H_2$=11.4%

CO=6.7%

$CO_2$=0.24%

$N_2$=Remainder to 100%

The dew point of gases 24 is −34° C. Next, the gases 24 are channeled to a heat exchanger 26 so as to preheat the impure nitrogen 18, and may be utilized directly as protective atmosphere for thermal treatments, containing as they do wholly negligible quantities of oxidants.

COMPARATIVE EXAMPLE 2

Impure nitrogen containing 3% oxygen with methane in a ratio of impure nitrogen-to-methane of 16, is made to react directly with a catalyst identical to the one described in Example 1, at a temperature of 699° C.

The composition of the gases obtained in this manner is the following:

$H_2$=10.3%

CO =4.2%

$CO_2$=0.6%

$N_2$=Remainder to 100%

Their dew point of −9° C. is distinctly higher to the value of −34° C. of the gases obtained according to the invented process (Example 1). To obtain gases with a dew point of −34° C. by the process described in Example 2, the reaction temperature would have to be raised to 728° C.

Hence, to obtain gases with the identical dew point, the invented process allows reforming to take place at a temperature 76 degrees lower than the process utilized in Example 2.

A reduction of even a few dozen degrees of reforming temperature is a decisive advantage, inasmuch as it reduces the degree of sintering of the catalyst and, by the same token, its loss of activity, while enhancing the thermal efficiency of the process and reducing the need for outside heat input.

EXAMPLE 3

A mixture of air 10 and natural gas 12 in an air-to-gas ratio of 1.5 is fed to an oxidative coupling reactor 14 (FIG. 1), containing as catalyst samarium oxide. The gas at the outlet contains $C_2H_4$=4%

$CH_4$=4% in addition to CO, $H_2$ and $N_2$ and minute quantities of $H_2O$ and $CO_2$.

Next, the gases 16 are added to impure nitrogen 18 containing 1% of oxygen, obtained by membrane separation. The ratio of impure nitrogen 18 to the gases 16 is 3. The oxygen contained in nitrogen 18 reacts immediately with a portion of the carbon monoxide and oxygen contained in the gases 16, forming water and carbon dioxide. The gaseous mixture 20 so obtained is fed to a reforming reactor 22 containing as catalyst 1% by weight of platinum on an alumina substrate. The spatial velocity is 25,000 $h^{-1}$ and the mean temperature is 550° C. The composition of the gases 24 at the output of reactor 22 is as follows:

$H_2$=11.6%

CO=5.8%

$N_2$=Balance $CO_2$=negligible quantities $CH_4$=negligible quantities

The dew point of gases 24 is −35° C., nearly equal to the gases produced in Example 1, but obtained at a decisively lower reforming temperature (550° C. vs. 652° C.), due to the presence of discrete quantities of ethylene. The gases 24 are fed to a heat exchanger 26, so as to preheat impure nitrogen 18, and may then be utilized directly as protective atmosphere for thermal treatments, containing as they do wholly negligible quantities of oxidants.

Without prejudice to the principles of the invention, it is understood that the implementing particulars and the mode of execution may vary within ample limits from the ones described above, without thereby exceeding its scope.

What is claimed is:

1. A process for maintaining a protective atmosphere in a thermal treatment process comprising:

(a) generating a first reaction product mixture comprising hydrocarbons having two or three carbons, carbon monoxide and hydrogen by reacting a gaseous hydrocarbon feed and an oxidant in a ratio of flow of said oxidant to said hydrocarbon feed having a range of from 2.3 to 0.5 with a first catalyst selected from the group consisting of ruthenium, rhodium, palladium, osmium, platinum and mixtures thereof or Li/MgO, $Li/Sm_2O_3$, $SrLa_2O_3$ and mixtures thereof, the catalyst being supported on a ceramic substrate selected from the group consisting of magnesium oxide, silica, zirconium oxide, titanium oxide and mixtures thereof;

(b) providing a gas stream from a protective atmosphere from a thermal treatment process, said gas stream comprising an oxygen containing nitrogen;

(c) combining the first reaction product from step (a) and the gas stream from step (b);

(d) reacting the oxygen in said gas stream with carbon monoxide and hydrogen formed in step (a) to form water and carbon dioxide;

(e) reacting the carbon monoxide and hydrogen with said hydrocarbons formed in step (a) over a second catalyst selected from the group consisting of noble metals, ruthenium, rhodium, palladium, osmium, platinum and mixtures thereof, to convert carbon monoxide and hydrogen, thereby reducing the dew point of the gas, (f) returning the gas of step (e) to the thermal treatment.

2. The process of claim 1 wherein said oxidant comprises oxygen.

3. The process of claim 1 wherein said oxidant is air.

4. The process of claim 1 wherein said first catalyst is at a temperature between about 750° C. to about 900° C. and a space velocity of at least about 10,000 $h^{-1}$.

5. The process of claim 1 wherein said first reaction product also comprises hydrocarbon, water and carbon dioxide.

6. The process of claim 1 wherein said second catalyst is a noble metal at a temperature of from about 400° C. to about 750° C.

7. The process of claim 1 wherein said dew-point gaseous mixture comprises nitrogen, hydrogen and carbon monoxide.

8. The process of claim 1 wherein said hydrocarbon is selected from the group consisting of methane, propane or natural gas.

9. The process of claim 1 wherein said ratio of flow of oxidant to the hydrocarbon feed ranges from between 2 and 0.8.

10. The process of claim 1 wherein the ratio of impure nitrogen and the first reaction product is between about 10 to about 1.

11. The process of claim 10 wherein said ratio of impure nitrogen and said first reaction product is from about 6 to about 1.

12. The process of claim 1 wherein said first catalyst is carried by a ceramic substrate selected from the group consisting of ruthenium, rhodium, palladium, osmium, platinum and mixtures thereof.

13. The process of claim 1 wherein said ceramic substrate is chosen from the group consisting of alumina, magnesium oxide, silica, zirconium oxide, titanium oxide and mixtures thereof.

14. The process of claim 1 wherein said first catalyst is selected from the group consisting of Li/MgO, $Li/Sm_2O_3$, $Sr/La_2O_3$ and mixtures thereof.

* * * * *